US007984682B2

(12) United States Patent
Stutznäcker et al.

(10) Patent No.: US 7,984,682 B2
(45) Date of Patent: Jul. 26, 2011

(54) MULTIPLE NEEDLE SEWING MACHINE AND METHOD FOR SEWING LARGE-AREA SEWING MATERIAL

(75) Inventors: Klaus Stutznäcker, Frechen (DE); Christian Koster, Neustadt (DE); Christian Sturm, Krefeld (DE)

(73) Assignee: Nahmaschinenfabrik Emil Stutznacker GmbH & Co. KG, Cologne (DE)

( * ) Notice: Subject to any disclaimer, the term of this patent is extended or adjusted under 35 U.S.C. 154(b) by 437 days.

(21) Appl. No.: 12/117,551

(22) Filed: May 8, 2008

(65) Prior Publication Data

US 2008/0289551 A1 Nov. 27, 2008

(30) Foreign Application Priority Data

May 9, 2007 (DE) ..... 10 2007 022 233
Dec. 14, 2007 (DE) ..... 10 2007 060 388

(51) Int. Cl.
*D05B 11/00* (2006.01)
*D05B 27/10* (2006.01)

(52) U.S. Cl. ..... 112/117; 112/163

(58) Field of Classification Search ..... 112/102, 112/102.5, 103, 117, 118, 303–318, 470.31, 112/475.08, 475.18, 163
See application file for complete search history.

(56) References Cited

U.S. PATENT DOCUMENTS 1,553,836 A 9/1925 Pierce
2,281,308 A * 4/1942 Johnson ..... 112/117
2,397,838 A * 4/1946 Chavannes ..... 156/164
3,616,770 A * 11/1971 Blyther et al. ..... 112/470.31
4,038,047 A * 7/1977 Haywood ..... 51/295
4,651,658 A * 3/1987 Vogel ..... 112/118
5,022,336 A * 6/1991 Iwase ..... 112/304
5,934,041 A * 8/1999 Rudolf et al. ..... 53/118
5,974,994 A 11/1999 Stutznäcker et al.
6,237,517 B1 5/2001 Bondanza et al.
6,290,800 B1 * 9/2001 Antinori et al. ..... 156/276

FOREIGN PATENT DOCUMENTS

DE 196 10 979 C1 11/1997
JP 11076655 A 3/1999

* cited by examiner

*Primary Examiner* — Ismael Izaguirre
(74) *Attorney, Agent, or Firm* — John Wilson Jones; Jones & Smith, LLP

(57) ABSTRACT

The invention relates to a multiple needle sewing machine for sewing large-area sewing material (28) which consists of several layers, at least two layers (6, 15, 21), whereof one layer (15) at least is formed of an elastic material, which multiple needle sewing machine comprises a sewing unit, a supply device for the layers to be sewn together (6, 15, 21), a storage device for withdrawing and storing the sewn layers (6, 15, 21) from the sewing unit, as well as a device which is arranged upstream of the sewing unit and by which the layer (15) made of an elastic material is supplied to the sewing unit in a non-stretched condition or tendentiously in the region of the device in a tendentiously compressed condition, together with said one or said further layers (6, 21), while retaining the compression. For improving a multiple needle sewing machine of the above-described type to the effect that it is possible to produce almost any sewing pattern while simultaneously facilitating the handling, it is proposed with the invention that the device which is arranged upstream of the sewing unit includes cylinders (33, 34) which guide the layers to be sewn together (6, 15, 21) and which are adapted for being automatically driven.

17 Claims, 6 Drawing Sheets

PRIOR ART

MULTIPLE NEEDLE SEWING MACHINE AND METHOD FOR SEWING LARGE-AREA SEWING MATERIAL

Figure 1:
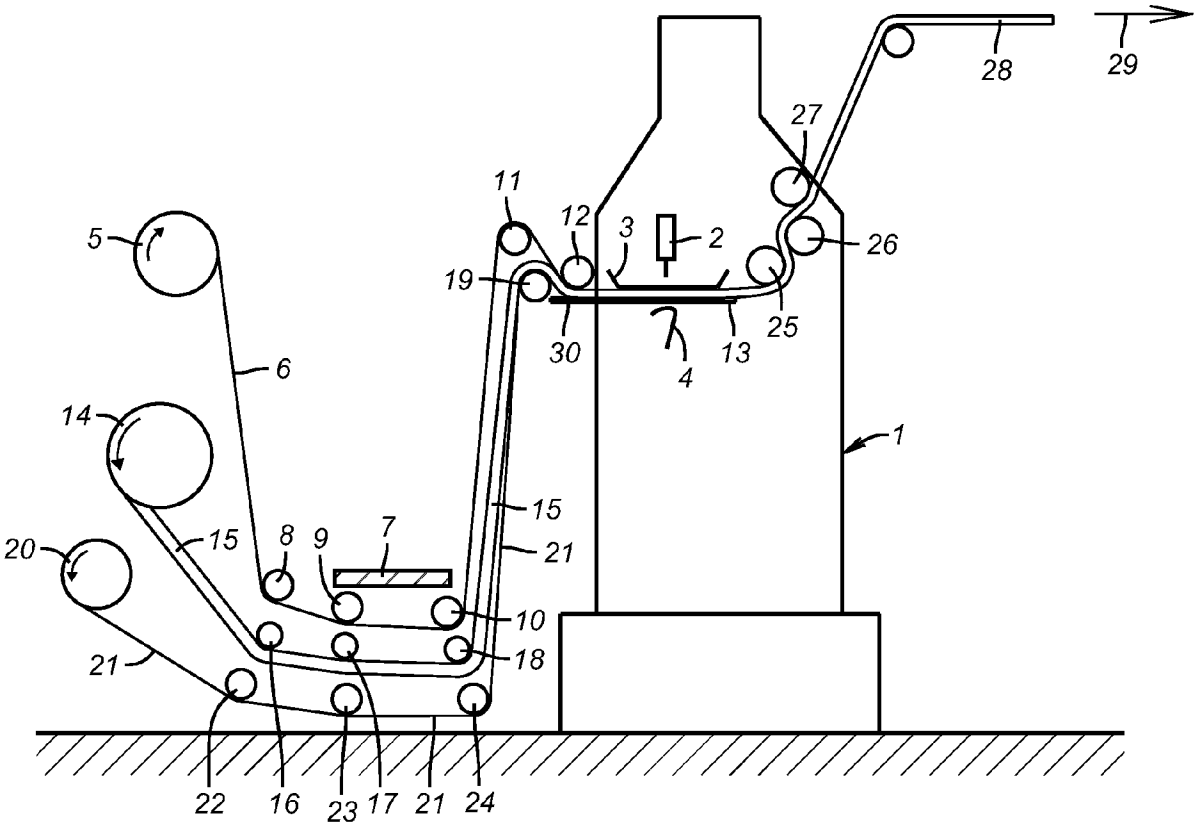

The invention relates to a multiple needle sewing machine for sewing large-area sewing material which consists of several layers, at least of two layers, whereof one layer at least is formed of an elastic material, said multiple needle sewing machine including a sewing unit, a supply device for the layers to be sewn together, a storage device for withdrawing and receiving the sewn layers from the sewing unit as well as a device which is arranged upstream of the sewing unit and by which the layer of elastic material is supplied to the sewing unit in a non-stretched condition or tendentiously in the region of the device in a tendentiously compressed condition, together with said one or said further layers, while retaining the compression.

A multiple needle sewing machine of the above-described type is known from DE 196 10979C1.

Although the multiple needle sewing machine known from DE 196 10 979C1 proved itself in the practice, there is a need for an improvement. It is especially a simplified handling which is striven for. Moreover, it shall be possible in an easy way to produce almost any sewing pattern.

Therefore, the invention is based on the problem of improving a multiple needle sewing machine which is pre-known from DE 196 10 979C1to that effect that almost any sewing pattern can be produced, while simultaneously simplifying the handling.

For the solution of this problem the invention proposes that the device which is arranged upstream of the sewing unit includes cylinders guiding the layers to be sewn together and adapted for being automatically driven. The improvement according to the present invention resides in a device which is arranged upstream of the sewing unit and which includes cylinders that can be automatically driven. By means of these cylinders the layers to be sewn together are supplied to the sewing unit, said cylinders, as a result of being driven, pushing or urging the layers to be sewn together into the sewing unit. Since the cylinders which guide the layers to be sewn together can be driven independently, it is possible in an advantageous manner to selectively influence the speed of feeding the individual layers into the sewing unit.

In the multiple needle sewing machine which is pre-known from prior art according to DE 196 10 979C1a conveyor device is arranged downstream of the sewing unit which pulls the sewing material that has been sewed together from the individual layers out of the sewing unit. As a result of this conveyor device pulling the sewing material out of the sewing unit, the individual layers to be sewn together are pulled into the multiple needle sewing machine, i.e. the sewing unit, where the individual layers are then sewn up to form the sewn material. In order to achieve that the individual layers are pulled into the sewing unit in a desired manner, the sewing unit in the multiple needle sewing machine which is pre-known from prior art has arranged on the upstream side thereof a plurality of deflection rollers for the individual layers to be sewn together, which deflection rollers have the function of either stretching or compressing the individual layers to be fed to the sewing unit in the conveying direction, in order to avoid undesired formation of wrinkles.

Although the above-described arrangement according to prior art proved itself in everyday practical use, it is not free of disadvantages concerning the design of the finished product desired by the customers.

For instance, customers frequently desire that an elastic material (knit ware) is used instead of the mostly employed drill (woven material) as an upper material. An upper material formed of an elastic material cannot be processed in the desired manner in a multiple needle sewing machine which is known from prior art according to DE 196 10 979, because the upper material which is formed of an elastic material will be subject to an undesired stretching as a result of the deflection rollers which are arranged on the upstream side of the sewing unit, with the consequence that undesired wrinkles are formed in the finished sewn material.

Another requirement on part of the customers is that it should be possible to produce almost any sewing pattern on the upper side of the sewing material, including for instance sewing patterns in the form of divided circles, which means in turn that during the actual sewing operation the layers to be sewn together must be freely displaceable relative to the needle row of the sewing unit. Hence, it must be possible to move the individual layers through the sewing unit also in a direction opposite to the actual conveying direction, in order to be able to form sewing patterns as desired by the customers. In the pre-known multiple needle sewing machine according to DE 196 10 979a movement of the layers in the direction opposite to the actual feeding direction is possible only to a limited extent, especially in a case where a material which is at least partially elastic is employed as an upper material. In this case namely it cannot be guaranteed that the later sewn material will be free of wrinkles as demanded.

This is remedied by the arrangement according to the present invention. Differently from the above-mentioned prior art, the individual layers to be sewn together are fed to the sewing unit not solely as a result of a pulling device which is arranged downstream of the sewing unit in the feeding direction. There is rather provided a device which is arranged upstream of the sewing unit in the feeding direction and which includes cylinders that can be automatically driven. The term "automatically" driven cylinders in the sense of the present invention is understood to mean that the cylinders are motor-driven in at least one rotating direction. Here, the driving of the rollers may be effected directly through corresponding motors such as servo or control motors or indirectly through other driving means such as V-belts, chains or the like. If V-belts are employed for instance for driving the cylinders, the same may be driven through the pulling device which is arranged downstream of the sewing unit. The driving of the cylinders takes place in at least one rotating direction which preferably is the returning direction. According to a further proposal of the invention it is provided for the cylinders to be driven at different speeds. Preferably, the rotational speeds of the cylinders are adjustable independently, which fact allows an optimum adjustment of the cylinders for the respective case of operation.

The cylinders which are provided according to the invention and which can be driven automatically feed the individual layers to be sewn together into the sewing unit, with the individual layers being pushed or urged into the sewing unit, which pushing or urging action is accompanied by an adjustable compression of the individual layers in dependence of the feeding speed, i.e. in dependence of the thrust or the urging force which is produced thereby. Advantageously, deflection rollers which are provided according to prior art for stretching or compressing the individual layers may be completely omitted.

The arrangement according to the invention offers a number of advantages: By virtue of the cylinders which are adapted for being driven automatically, the feeding, i.e. the conveying speed of the individual layers into the sewing unit can be selectively influenced. Hence, it is possible to predetermine the speeds of the introduction of the individual layers, especially of the uppermost and the lowermost layer, into the sewing unit relative to each other and to coordinate these speeds in such a way that the individual layers to be sewn together are introduced into the sewing unit in a condition in which they are stretched, tendentiously stretched, compressed, tendentiously compressed, or non-stretched or noncompressed, in order to avoid an undesired formation of wrinkles in the later sewn material.

The arrangement according to the present invention advantageously allows also the processing of upper material which is at least partially elastic. Differently from deflection rollers which are not automatically driven and which are known from prior art, an automatically driven cylinder accounts for an at least partially elastic design of the upper material, namely in as much as for avoiding the formation of undesired wrinkles in the finished sewn material the conveying speed is appropriately adjusted in dependence of the elasticity of the upper material. Unfavorably, this is not possible in the multiple needle sewing machines which are known from prior art.

The above-described construction still includes a further advantage. By virtue of the cylinder which can be driven automatically it is now possible to move the individual layers of the material to be sewn and/or the finished sewn material through the sewing unit not only in the conveying direction, but also in the opposite direction, i.e. in the returning direction. Accordingly, the individual layers can be moved to and fro within the sewing unit. Hence, in combination with a moving direction running transversely to the conveying direction any sewing pattern may be produced, for instance also divided-circle patterns or the like.

According to a further feature of the invention the cylinders which are constructed for being driven automatically are formed in such a way that they are movable relative to each other. This may be achieved for instance by the fact that one or both cylinders are movable relative to the plane which is formed by the sewing material by means of a pneumatically operating cylinder for instance. In this way it is possible to adjust the distance between the two preferably mutually oppositely arranged cylinders, namely in dependence of the thickness of the material, i.e. the thickness of the material of the layers to be sewn together. Thus the multiple needle sewing machine according to the invention is suitable for processing a number of different materials, be it with regard to the thickness of the material or with regard to the elasticity of the material. Incidentally, due the adjustable arrangement of the cylinders, the contact pressure and hence the friction between the cylinders on one side and the layers to be guided thereby on the other side may be adjusted, thereby ensuring that the individual layers are conveyed by the cylinders as desired.

Due to the movable arrangement of the cylinders it is also possible to readily exchange the upper material, i.e. the upper layer to be processed. In the multiple needle sewing machines which are known from prior art the deflection rollers which are provided here make it difficult and time-consuming to change over to an upper material which is to be processed next. In the multiple needle sewing machines which are known from prior art the insertion of an upper material that has to be processed next takes several minutes time. In the multiple needle sewing machine in accordance with the present invention the change from a currently used upper material to an upper material which has to processed next is possible within a considerably shorter time of e.g. less than one minute. Namely, for the insertion of an upper material which has to processed next it is merely required to relatively move the cylinders which are devised for being automatically driven away from each other for enlarging the insertion jaw. Deflection rollers which may be disturbing are anyway not provided in the construction according to the invention, so that a change to an upper material which has to be processed next can be effected easily and quickly. Hence, compared to prior art, the multiple needle sewing machine constructed according to the present invention can be operated much more effectively. This advantage is the more important with regard to the fact that compared to former times customized orders have to be carried out today, of which the batches often comprise only a few running meters, which means that the upper material to be sewn has to be changed rather frequently.

According to a further feature of the invention it is provided that in the direction of the layers to be sewn together between the device which is arranged upstream of the sewing unit and the sewing unit a conveying element which is shaped as at least a section of a circle of an arc is formed and is arranged substantially directly before a pressure foot of the sewing unit. This conveying element may for instance be in the form of a roll or a cylinder which is preferably displaceable in its relative position to a support which receives the layers to be sewn together. In this way, layers having different material thicknesses can be processed without negatively influencing the advantageous effect of the multiple needle sewing machine according to the invention. In this case, either the conveying element may be adjustable with respect to the support or the support may be adjustable with respect to the conveying element. According to a further feature this roll or cylinder can be driven automatically, so that through the driving of the roll or cylinder an additional component of forces is transmitted to the upper layer of the layers to be sewn together. The conveying element may also be referred to as a conveying cylinder or a sewing material guide cylinder. The speed at which the conveying element is driven is preferably adjustable. In this case, the conveying element is adapted for being driven in at least one rotating direction that is preferably determined by the returning direction. The driving may be effected directly through motors or indirectly through power transmission elements such as V-belts or the like.

According to a further feature the multiple needle sewing machine is characterized by a transport device which is arranged downstream of the sewing unit and which includes several rolls which guide the finished sewn material that has been sewn together and which are devised for being automatically driven. In this case, the rolls of the transport device can be preferably driven at different rotational speeds, so that synchronization is possible. Moreover, the driving of the rolls of the transport device can take place in dependence of the driving of the cylinders of the device which is arranged upstream of the sewing unit and vice versa, whereby it is possible to synchronize the individual rolls and/or cylinders which can be driven.

According to a further feature of the invention, for increasing the frictional resistance of the surfaces, the rolls of the transport device and/or the cylinders of the device which is arranged upstream of the sewing unit may be provided with a surface coating, for instance by being plastic-coated.

The cylinders of the device which is arranged upstream of the sewing unit and/or the rolls of the transport device which is arranged downstream of the sewing unit may be additionally driven both to the left and to the right. It is possible in this way to move the individual layers to be sewn together through the multiple needle sewing machine, i.e. the sewing unit not only in the conveying direction, but also in a direction opposite to the conveying direction.

According to a further feature of the invention the multiple needle sewing machine is characterized by a regulating or measuring device which serves for the automatic adjustment of the rotational speeds and/or the rotational directions of the rolls of the transport device which is arranged downstream of the sewing unit and/or of the cylinders of the device which is arranged upstream of the sewing unit. In this case, the rolls and/or cylinders are adjustable in dependence of pre-determinable parameters for achieving that a sewn material can be produced as requested.

With the present invention there is further proposed a method for sewing large-area sewing material in a multiple needle sewing machine, which sewing material consists of several layers, at least of two layers, whereof one layer at least is made of an elastic material, for instance a foamed material, wherein the layers placed one above the other are fed to a sewing unit and are conveyed in arbitrary directions within the sewing material plane, wherein the layer which is formed of an elastic material is supplied to the sewing unit in a condition which is non-stretched or tendentiously compressed in the conveying direction and is sewn together with the layer that is formed of a non-elastic material, characterized in that the layers which are to be sewn together to form the sewing material are supplied to the sewing unit by a device which is arranged upstream of the sewing unit in the conveying direction and which includes automatically driven cylinders which guide the layers to be sewn together.

These automatically driven cylinders, also referred to as sewing material guide cylinders, urge or push the layers into the multiple needle sewing machine, i.e. into the sewing unit of the multiple needle sewing machine, as a result of the contact friction present between the individual layers and the cylinders. The cylinders may be operated at a different angular speed and/or tangential speed, so that it is possible to take selective influence on the conveying speed of the individual layers, which makes it possible in an advantageous manner to stretch the individual layers relative to each other, to tendentiously stretch, compress, tendentiously compress, not stretch or not compress these layers. In addition to that, the cylinders may be moved in their relative position to each other, which fact makes it possible in particular to facilitate the insertion of a further upper layer that is to be sewn.

Figure 2:
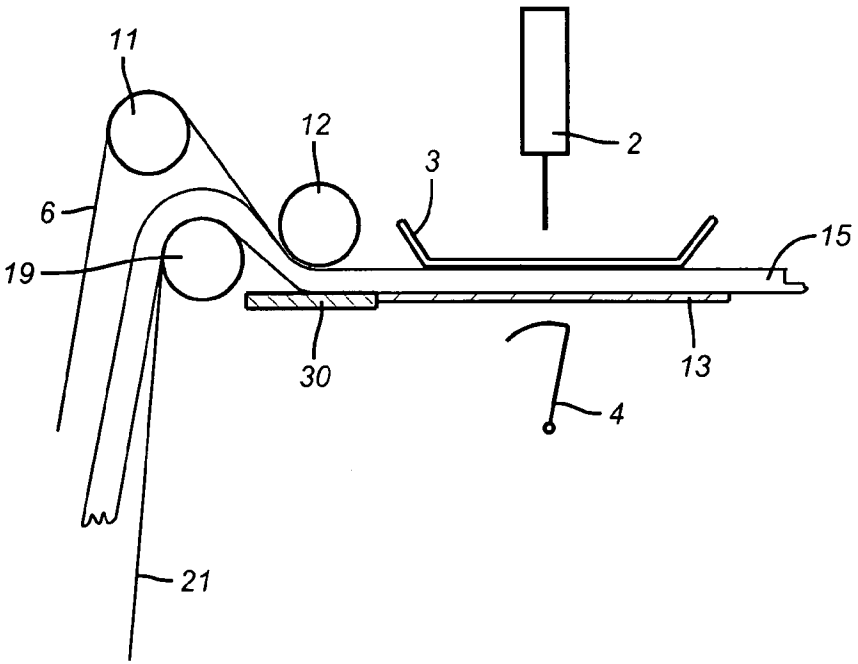
Figure 3:
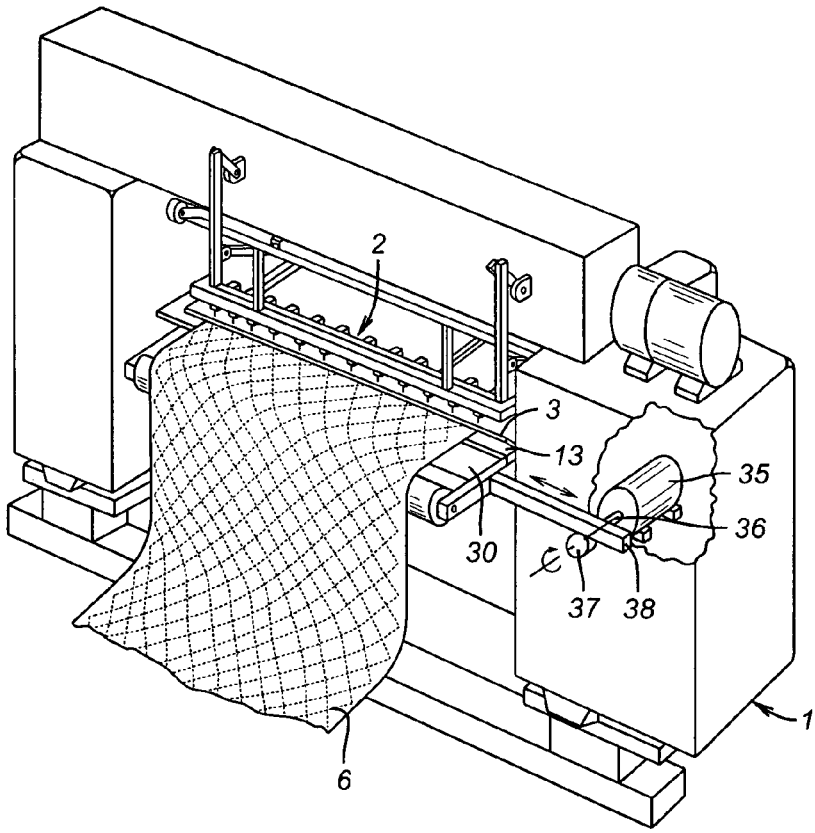
Figure 4:
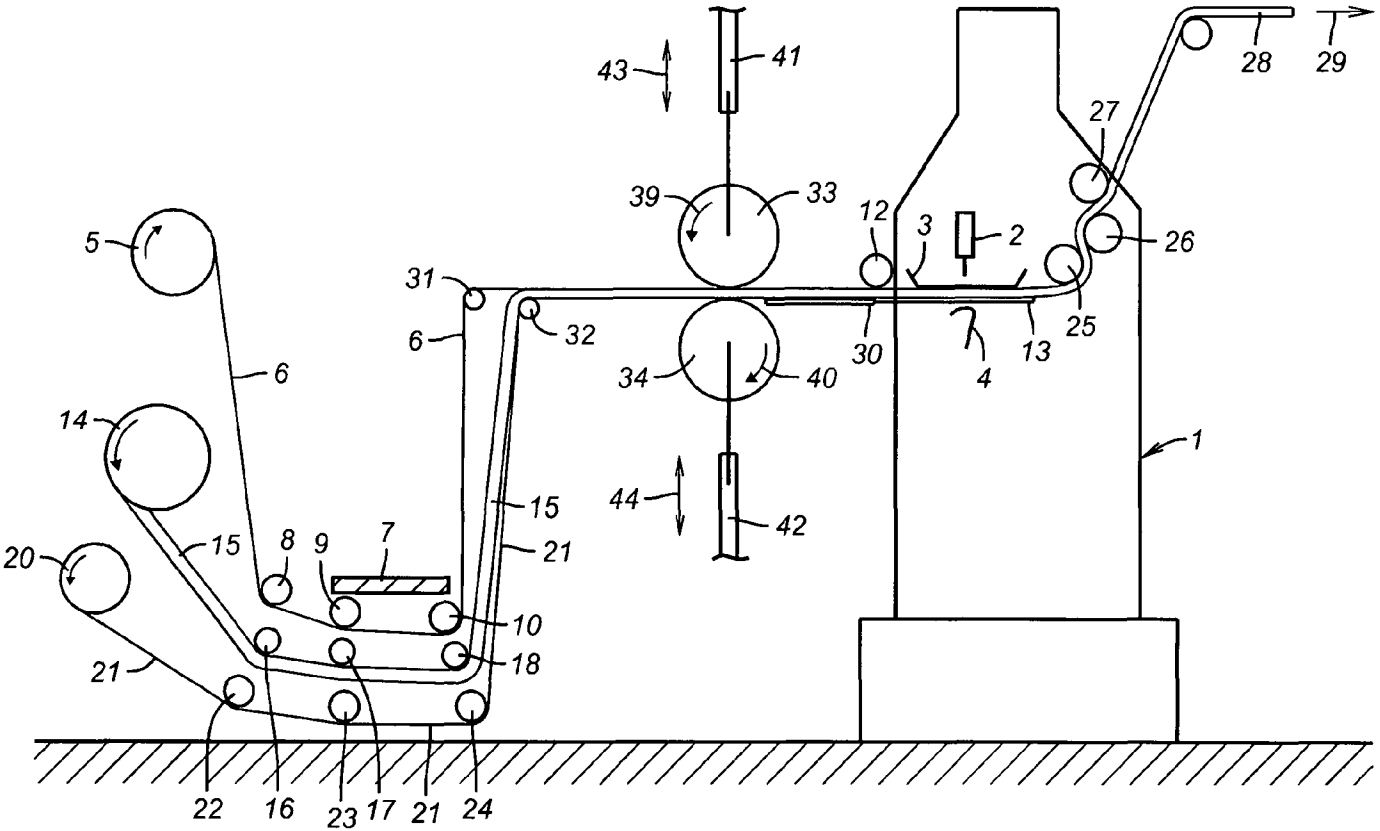
Figure 5:
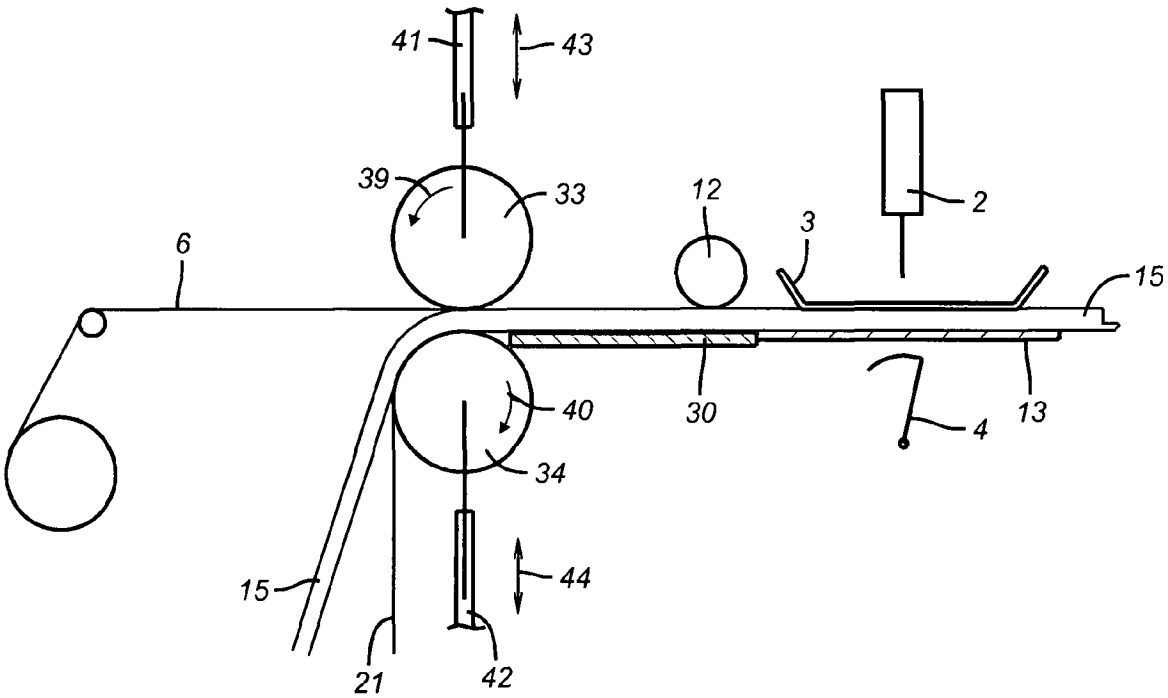
Figure 6:
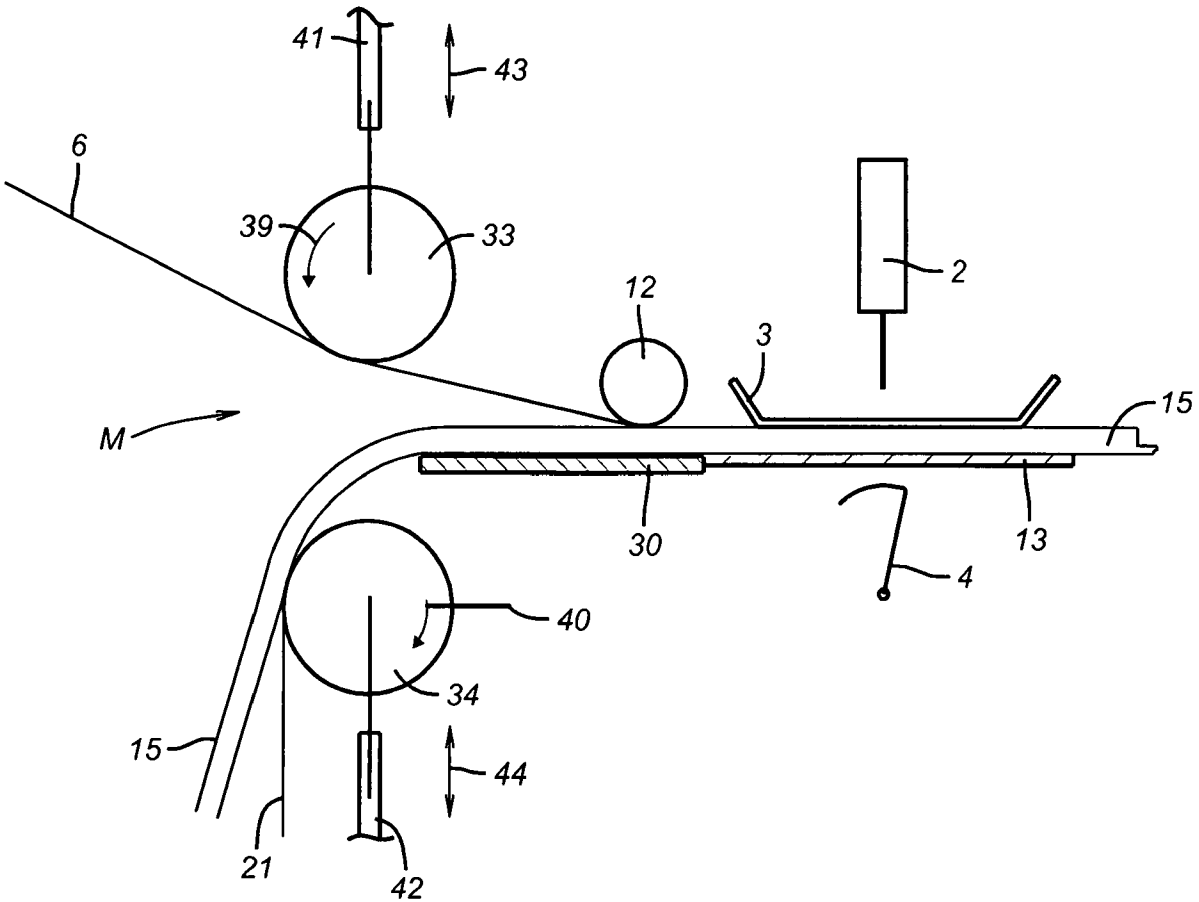

Further advantages and features of the invention will become apparent from the following description with reference to the attached drawings wherein it shown by:

FIG. 1 a multiple needle sewing machine according to prior art, in a schematic side view;

FIG. 2 a view of a detail of the multiple needle sewing machine according to claim 1;

FIG. 3 the multiple needle sewing machine according to FIG. 1, in a perspective view;

FIG. 4 a multiple needle sewing machine according to the invention, in a schematic side view;

FIG. 5 a view of a detail of the multiple needle sewing machine according to FIG. 4 and FIG. 6 a view of a detail of the multiple needle sewing machine according to FIG. 4, with the insertion jaw M open.

The FIGS. 1 to 3 show a multiple needle sewing machine of prior art according to DE 196 10 979. The multiple needle sewing machine includes a machine frame 1 having a needle row 2 in its upper part, wherein the individually driven needles are juxtaposed substantially perpendicular to the image plane. Reference number 3 designates a common pressure foot and reference number 4 designates a shuttle row corresponding to the needle row 2. Under the layers which are combined within the sewing area a needle plate 13 or sewing table is arranged.

The sewing material consists of an upper layer 6, e.g. a face fabric, a mattress drill or the like, and is paid off from a feed roll 5 and, in the illustrated example, guided around guide rollers 8, 9, 10 and 31 into the sewing zone, i.e. into the zone between the pressure foot 3 and the supporting plate 13, below an operator's platform. This layer 6 of the sewing material may consist of an elastic or non-elastic material. The sewing material additional includes a further layer 15 consisting of an elastic material, for instance a foamed material, which layer is stored on a feed roll. For this elastic layer 15 there are also provided guide or deflection rollers 16, 17, 18 and 32.

This layer 15 of elastic material is sewn together with the upper layer 6 as well as with a further layer 21 and is withdrawn from the sewing unit as finished sewn material 28 in the direction of arrow 29, while the feeding of the layers 6, and 21 is effected through the force which acts on the finished sewn material 28. After the sewing unit the finished sewn product 28 passes a distance which includes deflection or guide rollers 25, 26 and 27 and which provides among others for a stretching of the sewn material 28 in the exit area of the sewing unit.

The lower layer 21 which is paid off from a supply roll 20 is supplied to the sewing unit via deflection or guide rollers 22, 23 and 24, wherein corresponding to FIG. 1 the lower layer 21 may be also supplied together with the upper layer 6 and the layer 15 of the deflection roller 12 which will be described in more detail in the following.

Vis à vis of the deflection roller 12 a support 30 is arranged, wherein the distance between the outer circumference of the deflection roller 12 and the support 30 is adjustable, which means that either the deflection roller 12 is movable relative to the support 30 or the support 30 is movable relative to the deflection roller 12. Alternatively it may be provided that both the support 30 and the deflection roller 12 are adjustable in the vertical direction. This arrangement serves for the adaption of the multiple needle sewing machine to differently thick layers 6 and 15, wherein the layer 15 of elastic material is formed much thicker than the layer of woven or knitted material. It is required that the deflection roller 12 acts on the layers 6, 15 with a certain pressure, in order to provide the required frictional forces.

The deflection roller 12 represents a device which is arranged upstream of the sewing unit and with which the layer 15 of elastic material is supplied to the sewing unit at a speed which is higher with regard to the speed of the layer 6 which consists of a woven or knitted material, wherein the layer 15 of elastic material is compressed in the region of the deflection roller 12 and, together with the upper layer 6 and the lower layer 21, is supplied to the sewing unit 6, while keeping the compression. To this end, the deflection roller for the upper layer 6 is arranged above the deflection roller 19 for the layer 15, so that the upper layer 6 ascends the deflection roller 12 under a larger angle relative to the surface of the support 30 or the needle plate 13 than the layer 15 of elastic material which is passed over the deflection roller 19. Here it is required that both the upper layer 6 and the layer 15 of elastic material ascend the deflection roller 12 under an angle larger than 5° relative to the surface of the support 30 or the needle plate 13. Due to this arrangement the circumferential distance of the upper layer 6 on the deflection roller 12 is smaller than the circumferential distance of the layer 15 of elastic material, since the radius of the deflection roller 12 is smaller than the radius of the deflection roller 12 plus almost half the material thickness of the layer 15 of elastic material, in which layer the neutral line is arranged, i.e. the line at which the elastic material is neither stretched nor compressed while wrapping around the deflection roller 12. Due to this arrangement the layer 15 of elastic material is given a slightly higher conveying speed than the layer 6 of non-elastic material, so that as a result a compression of the elastic material occurs in the region between the deflection roller 12 and the pressure foot 3, which compression is maintained up and into the region of the needle row 2 or the needle rows 2, so that the upper layer 6 in a stretched state is sewed together with the compressed layer 15 of the elastic material. Through this, stretching of the elastic material caused by the frictional resistance also on the surface of the support 30 or on the lower layer is compensated, which leads to the fact that the contraction of the previously stretched material which takes place after the sewing operation is omitted.

Depending on the configuration of the above-described device the stretching of the elastic material may be compensated by a corresponding compression or a compression of the elastic material may be made which overcompensates the expansion of the elastic material, so that after the sewing operation the elastic material will expand and stretch the upper layer 6.

According to FIG. 3 it may be seen that the pressure foot 3 and the needle plate 13 are not movable in the longitudinal direction of the machine frame 1. Compared thereto the support 30 is arranged to be movable relative to the pressure foot 3 and the needle plate 13 in the longitudinal direction of the machine frame, i.e. transversely to the main conveying direction, so that the sewing material of which only the upper layer 6 is illustrated in FIG. 3 is movable relative to the needle rows 2 in such a way that any sewing pattern may be transferred to the sewing material. For moving the support 30 an electric motor 35 is provided in the machine frame which includes on its driving shaft 36 a pinion 37 which meshes with the teeth of a rack 38 which is rigidly connected to the support 30.

Although a multiple needle sewing machine as described by way of the FIGS. 1 to 3 proved itself in everyday practice, there is a need for an improvement, especially with view to the modern requirements of being capable of processing also such an upper layer 6 which is formed of an at least partially elastic material.

The FIGS. 4 to 6 show a multiple needle sewing machine according to the invention. As it may be seen especially in comparison with the FIGS. 1 and 2, the multiple needle sewing machine according to the invention has a device which is arranged upstream of the sewing unit and which includes the cylinders 33 and 34 which can be driven automatically, namely corresponding to the direction of the arrows 39 and 40 or vice versa, if the conveying operation shall be performed in a direction opposite to the conveying direction 29. The cylinders 33 and 34 are formed to be movable relative to each other by means of pneumatic cylinders 41 and 42 for instance, corresponding to the arrows 43 and 44. According to this embodiment, the layers 6, 15 and if need be also the layer 21, which are to be connected to each other, are fed to the automatically driven cylinders 33 and 34 via the deflection rollers 31 and 32 which introduce the individual layers to be sewn together into the sewing unit substantially linearly with regard to the plane which is provided by the support 30, whereat these layers are pushed or urged with regard to the conveying direction 29. When the cylinders 33 and 34 are driven in the opposite direction, they cause that the individual layers to be sewn together are pulled out of the sewing unit, i.e. in a direction opposite to the conveying direction 29.

As it may be seen especially from a comparison of the FIGS. 1 and 4, the deflection rollers 11 and 19 which are still provided in the prior art construction as shown in FIG. 1 are omitted in the arrangement according to the invention and are replaced by the automatically driven cylinders 33 and 34. This further development provides a great number of advantages.

On one side, this comparatively complicated arrangement according to FIG. 1 is no longer required for achieving a desired stretching or compression of the individual layers relative to each other. And, differently from the arrangement according to FIG. 1, the cylinders 33 and 34 which are now driven automatically make it possible to selectively take influence on the conveying speed of the individual cylinders, which allows the processing of different layers 6, 15 and also of the layer 21, if need be, which layers are different from each other with regard to their material properties, especially with regard to their elasticity. It is possible in this way, to process in particular upper layers 6 which are partially elastic or fully elastic. This is not possible with an arrangement as shown in FIG. 1.

A further advantage resides in the fact that layers can be easily exchanged for layers which are to be processed next. This is clearly explained by a comparison of the FIGS. 5 and 6. In the illustration according to FIG. 6, an enlarged insertion jaw is obtained by the cylinders 33 and 34 having been moved from their working position shown in FIG. 5 to the open position shown in FIG. 6. The illustration according to FIG. 6 clearly shows that with the cylinders 33 and 34 in the open position the individual layers, especially the layer 6, may be readily grabbed by the operator and exchanged for further layers to be processed.

The layers 33 and 34 are in a frictional connection with the layers to be conveyed by them, whereat the frictional force between the cylinders 33 and 34 and the layers 6 and 15 and 21, if need be, may be adjusted according to the requirements due to the contact pressure which is applied to the respective layers by the cylinders 33 and 34 as a result of the pneumatic cylinders 41 and 42.

The rollers 33 and 34 can be driven in way as shown by the arrows in the FIGS. 5 and 6, which fact causes the individual layers to be conveyed, i.e. pushed or urged into the sewing unit in the conveying direction 29. The cylinders 33 and 34 may be driven also in the opposite direction, which fact causes the individual layers to be pulled out of the sewing unit in a direction opposite to the conveying direction 29. Hence, the individual layers or the sewing material 28 may be moved to and fro with respect to the sheet plane according to the FIGS. 5 and 6. Accordingly, in combination with a moving direction of the individual layers or the sewing material which runs transversely to the sheet plane according to the FIGS. 5 and 6, different sewing patterns may be produced, for instance also sewing patterns which are in the shape of a divided circle. The deflection roller 12 which is not automatically driven in the prior art construction is automatically driven in the construction according to the invention, for which reason this roller may also be referred to as conveying element 12. The speed, i.e. the rotational speed and/or the tangential speed of the conveying element 12 which is devised as a cylinder or as a roller is preferably adjustable as is the rotating direction. Preferably, also the conveying element 12 can be driven in at least one rotating direction, for instance in the returning direction.

With the device according to the invention as shown exemplarily in the FIGS. 4, 5 and 6, it becomes possible for the first time to process also upper layers 6 which are at least partially elastic, namely in a way such that the stretching or expansion of the individual layers to be sewn together is matched to the effect that the later sewn material 28 does not include any wrinkles. The handling of the device according to the invention is much easier compared to prior art, especially with view to an exchange of the layers to be processed, particularly the upper material 6 to be processed.

In addition, the arrangement according to the invention makes it possible to regulate or control the entire sewing operation and especially the feeding of the individual layers. This may be achieved for instance by having the driving motors of the cylinders 33 and 34 which are preferably formed as servo motors incorporated in a regulating or control device which adjusts the rotational speeds and/or the rotational directions of the cylinders 33 and 34 as required by pre-determinable parameters in dependence of the desired result. In addition to that, an adjustment to the deflection rollers 25 and 26 and 27 of the transport device may be accomplished, which fact allows an overall synchronization of the entire system.

LIST OF REFERENCE NUMBERS

1 machine frame 30 support
2 needle row 31 deflection roller
3 pressure foot 32 deflection roller
4 shuttle row 33 upper roller
5 supply roll 34 lower roller
6 upper layer 35 electric motor
7 platform 36 driving shaft
8 deflection roller 37 pinion
9 deflection roller 38 rack

10 deflection roller 39 arrow
11 deflection roller 40 arrow
12 conveying element 41 cylinder
13 needle plate or sewing table 42 cylinder
14 supply roll 43 arrow
15 position 44 arrow
16 deflection roller
17 deflection roller M insertion jaw
18 deflection roller
19 deflection roller
20 supply roll
21 position
22 deflection roller
23 deflection roller
24 deflection roller
25 deflection or guide roller
26 deflection or guide roller
27 deflection or guide roller
28 sewing material
29 arrow

The invention claimed is:

1. A multiple needle sewing machine for sewing large-area sewing material which consists of at least two layers, wherein at least one layer is formed of an elastic material, said multiple needle sewing machine comprising a sewing unit, a supply device for the layers to be sewn together, a storage device for withdrawing and receiving the sewn layers from the sewing unit, as well as a device which is arranged upstream of the sewing unit and by which the layer of elastic material is supplied to the sewing unit in a non-stretched condition or tendentiously in the region of the device in a tendentiously compressed condition, together with said layers, while retaining the compression, characterized in that the device which is arranged upstream of the sewing unit includes cylinders which guide the layers to be sewn together and which are adapted for being automatically driven, the rotational speeds of the cylinders capable of being adjusted independently from each other.

2. The multiple needle sewing machine according to claim 1, characterized in that the cylinders are adapted for being movable relative to each other.

3. The multiple needle sewing machine according to claim 1, characterized in that the direction of the layers to be sewn together between the device which is arranged upstream of the sewing unit and the sewing unit a conveying element is formed which is in the form of at least a section of the circle of an arc and which is arranged directly before a pressure foot of the sewing unit.

4. The multiple needle sewing machine according to claim 3, characterized in that the conveying element is adapted for being driven.

5. The multiple needle sewing machine according to claim 1, characterized by a transport device which is arranged downstream of the sewing unit and which includes several rollers guiding the finished sewn material and adapted for being automatically driven.

6. The multiple needle sewing machine according to claim 1, characterized in that the cylinders of the device which is arranged upstream of the sewing unit and/or the rollers of the transport device which is arranged downstream of the sewing unit can be driven clockwise and anti-clockwise.

7. The multiple needle sewing machine according to claim 1, characterized by a regulating or control device for the automatic adjustment of the rotational speed and/or the rotating direction of the rollers and/or the cylinders.

8. The multiple needle sewing machine according to claim 1, characterized in that the rollers and/or the cylinders are provided with a surface coating, preferably of a synthetic material.

9. The multiple needle sewing machine according to claim 2, characterized in that the direction of the layers to be sewn together between the device which is arranged upstream of the sewing unit and the sewing unit a conveying element is formed which is in the form of at least a section of the circle of an arc and which is arranged directly before a pressure foot of the sewing unit.

10. The multiple needle sewing machine according to claim 9, characterized in that the conveying element is adapted for being driven.

11. The multiple needle sewing machine according to claim 1, wherein the cylinders are driven at different speeds.

12. A method for sewing a large-area sewing material in a multiple needing sewing machine, which sewing material consists of at least two layers, wherein at least one layer is made of an elastic material, comprising:

supplying the layers placed one on top of the other to a sewing unit and conveying the layers in arbitrary directions within the sewing material plane, wherein said layer which is formed of an elastic material is supplied to the sewing unit in a condition in which it is non-stretched or tendentiously stretched in the conveying direction and is sewn together with another layer, the layers to be sewn together are supplied to the sewing unit by a device which is arranged upstream of the sewing device in the conveying direction, which device includes cylinders for guiding the layers to be sewn together and adapted for being automatically driven; and adjusting the rotational speeds of the cylinders independently from each other.

13. The method according to claim 12, characterized in that the cylinders are driven with the rotational speed and the rotating direction being freely selectable.

14. The method according to claim 12, characterized in that the cylinders are driven in dependence of pre-determinable parameters.

15. The method according to claim 13, characterized in that the cylinders are driven in dependence of pre-determinable parameters.

16. The method according to claim 12, comprising the step of driving the cylinders at different speeds.

17. The method according to claim 12, wherein the elastic material is a foamed material.

* * * * *